US006298785B1

(12) United States Patent
Maehata et al.

(10) Patent No.: US 6,298,785 B1
(45) Date of Patent: Oct. 9, 2001

(54) BLASTING APPARATUS

(75) Inventors: Hidehiko Maehata; Hiroaki Arai; Daisuke Tamakoshi; Tetsuya Inoue, all of Osaka (JP)

(73) Assignee: Hitachi Zosen Corporation (JP)

( * ) Notice: Subject to any disclaimer, the term of this patent is extended or adjusted under 35 U.S.C. 154(b) by 0 days.

(21) Appl. No.: 09/486,304

(22) PCT Filed: Jul. 29, 1998

(86) PCT No.: PCT/JP98/03389

§ 371 Date: Feb. 24, 2000

§ 102(e) Date: Feb. 24, 2000

(87) PCT Pub. No.: WO99/12648

PCT Pub. Date: Mar. 18, 1999

(51) Int. Cl.[7] ..... F42B 3/18

(52) U.S. Cl. ..... 102/301; 102/202.7; 102/307; 102/313; 102/327

(58) Field of Search ..... 102/202.7, 307, 102/312, 313, 325, 326, 327, 301

(56) References Cited

U.S. PATENT DOCUMENTS 1,913,015 * 6/1933 Vodoz ..... 102/327
4,630,540 * 12/1986 Trocino ..... 102/307
4,905,601 * 3/1990 Gabriel et al. ..... 103/307
5,115,743 * 5/1992 Loffler ..... 102/202.7 X
5,170,004 * 12/1992 Garrison ..... 102/307 X
5,194,690 * 3/1993 Guthrie et al. ..... 102/307 X
5,576,509 * 11/1996 Refouvelet et al. ..... 102/202.7
5,619,008 * 4/1997 Chawla et al. ..... 102/313 X

FOREIGN PATENT DOCUMENTS

2362361 * 3/1978 (FR) ..... 102/202.7
59/213456 12/1984 (JP) ..... B02C/19/18
10131519 A 5/1998 (JP) ..... E04G/23/08

* cited by examiner

*Primary Examiner*—Peter A. Nelson
(74) *Attorney, Agent, or Firm*—Mark Kusner

(57) ABSTRACT

A thin metal wire 8 is fused and vaporized by a predetermined amount of electrical energy supplied to the thin metal wire 8 for a short period of time, whereby a blasting substance 3 is expanded in volume. Therefore, a vaporization expansion force caused by the fusion and vaporization of the thin metal wire 8 moves a shock delivering member 22, so that the shock delivering member 22, colliding with a to-be-blasted object H1, delivers a shock to the to-be-blasted object H1, thereby blasting the to-be-blasted object H1.

5 Claims, 5 Drawing Sheets

BLASTING APPARATUS

TECHNICAL FIELD

The present invention relates to a blasting apparatus in which a thin metal wire (an example of a substance which fuses and vaporizes) is fused and vaporized rapidly by electrical energy supplied thereto for a short period of time, and a concrete structure, base rock, or plate-shaped to-be-blasted object is blasted by using the vaporization expansion force caused by the fusion and vaporization.

BACKGROUND ART

There has conventionally been a blasting apparatus for blasting a to-be-blasted object such as concrete or base rock by using discharge energy.

This blasting apparatus has a thin metal wire connecting electrodes to each other, a blasting substance (for example, water or oil is used) for transmitting pressure, which is filled in a blasting vessel and immerses the thin metal wire therein, and an energy supply circuit for supplying electrical energy to the thin metal wire via the electrodes.

The following is a description of a blasting method for blasting a to-be-blasted object such as base rock by using the blasting apparatus configured as described above.

First, a mounting hole is formed in the to-be-blasted object and a blasting vessel is mounted in this mounting hole. Next, electrical energy having been charged in a capacitor, which is a constituent element of the energy supply circuit, is discharged and supplied to the thin metal wire for a very short period of time. Thus, the thin metal wire is fused and vaporized rapidly so as to be expanded, and the expansion force of the thin metal wire is transmitted toward the outside by means of the blasting substance. The expansion force acts in the diametrical direction of the mounting hole, for example, against the wall surface of the mounting hole, thereby blasting the to-be-blasted object.

As described above, in the case where the to-be-blasted object is a base rock or the like, if the mounting hole is formed in the to-be-blasted object, and the blasting vessel is mounted in this mounting hole, the expansion force caused by the fusion and vaporization of the thin metal wire acts in the diametrical direction of the mounting hole, so that a sufficient impact force is given to the to-be-blasted object, and consequently the to-be-blasted object is blasted. In the case where the to-be-blasted object is a plate-shaped object, however, no mounting hole is formed in the to-be-blasted object, and the blasting vessel is merely caused to abut on the surface of the to-be-blasted object, so that almost all of the expansion force caused by the fusion and vaporization of the thin metal wire escapes into the air, and consequently a sufficient blasting force cannot be given to the to-be-blasted object.

Accordingly, an object of the present invention is to provide a blasting apparatus which solves the above problem.

DISCLOSURE OF THE INVENTION

The present invention provides a blasting apparatus comprising: a shock delivering member incorporated movably in a vessel and delivering a shock to a to-be-blasted object by colliding with the surface of the to-be-blasted object; an expansion force generating section provided in the vessel and being capable of producing an expansion force for causing the shock delivering member to collide with the surface of the to-be-blasted object; said expansion force generating section including a pair of electrodes inserted through a cover member installed removably to an opening formed in the vessel, a thin metal wire connected between the electrodes, a fluid blasting substance for transmitting to the shock delivering member an expansion force generated when the thin metal wire is fused and vaporized rapidly by electrical energy supplied to the thin metal wire via the electrodes for a short period of time, a filling port for filling the blasting substance into the vessel, and a discharge port for discharging the blasting substance having been used from the vessel; sealing means for sealing the filling port and the discharge port, respectively; and a pressing means for pressing the vessel toward the to-be-blasted object.

According to this configuration, the electrodes are inserted through the cover member and connected to each other by the thin metal wire, the cover member is installed to the vessel, the blasting substance is filled into the vessel through the filling port and the filling port is sealed by the sealing means, and electrical energy is supplied to the thin metal wire via the electrodes for a very short period of time. Thus, the thin metal wire is fused and vaporized, and an expansion force generated at this time is transmitted to the shock delivering member by means of the blasting substance. Therefore, owing to the expansion force, the shock delivering member is caused to abut strongly on the to-be-blasted object and delivers a shock to the to-be-blasted object, so that even a plate-shaped to-be-blasted object can be blasted reliably.

Also, the blasting apparatus is characterized in that a plurality of pairs of electrodes are inserted through the cover member, and the thin metal wire is connected between the respective pair of electrodes.

According to this configuration where a plurality of thin metal wires are provided, when each thin metal wire is fused and vaporized by electrical energy supplied thereto, the expansion force is increased as compared with the case where one thin metal wire is provided. Therefore, owing to this increased expansion force, the shock delivering member delivers a shock to the to-be-blasted object, so that the to-be-blasted object can be blasted reliably.

Also, the present invention provides a blasting apparatus comprising: a shock delivering member incorporated movably in a vessel and delivering a shock to a to-be-blasted object by colliding with the surface of the to-be-blasted object; an expansion force generating section provided in the vessel and being capable of producing an expansion force for causing the shock delivering member to collide with the surface of the to-be-blasted object; said expansion force generating section including electrodes inserted in a pair into the vessel, thin metal wires inserted in each of the electrodes so as to be capable of extruding to a gap between the electrodes, a fluid blasting substance for transmitting to the shock delivering member an expansion force generated when the thin metal wire is fused and vaporized rapidly by electrical energy supplied to the thin metal wire via the electrodes for a short period of time, a filling port for filling the blasting substance into the vessel, and a discharge port for discharging the blasting substance having been used from the vessel; sealing means for sealing the filling port and the discharge port, respectively; and a pressing means for pressing the vessel toward the to-be-blasted object.

According to this configuration, the thin metal wire is extruded to the gap between the electrodes in each blasting work, and electrical energy is supplied to the thin metal wire extruded to the gap between the electrodes. Thereby, the blasting work can be performed continuously, so that the working efficiency of the blasting work can be improved.

Also, the blasting apparatus is characterized in that a plurality of pairs of electrodes are inserted into the vessel, and the thin metal wire is inserted in each of the electrodes so as to be capable of extruding to the gap between the paired electrodes.

According to this configuration where a plurality of thin metal wires are provided, when each thin metal wire is fused and vaporized by electrical energy supplied thereto, the expansion force is increased as compared with the case where one thin metal wire is provided. Therefore, owing to this increased expansion force, the shock delivering member delivers a shock to the to-be-blasted object, so that the to-be-blasted object can be blasted reliably.

Further, the blasting apparatus is characterized in that an inclined or curved reflecting face is formed in the vessel to concentrate the expansion force on the shock delivering member.

According to this configuration, the expansion force generated when electrical energy is supplied to the thin metal wire acts while being concentrated on the central portion of the shock delivering member by means of the inclined or curved reflecting face, so that the to-be-blasted object can be blasted reliably by the shock delivering member.

BEST MODE FOR CARRYING OUT THE INVENTION

Figure 1:
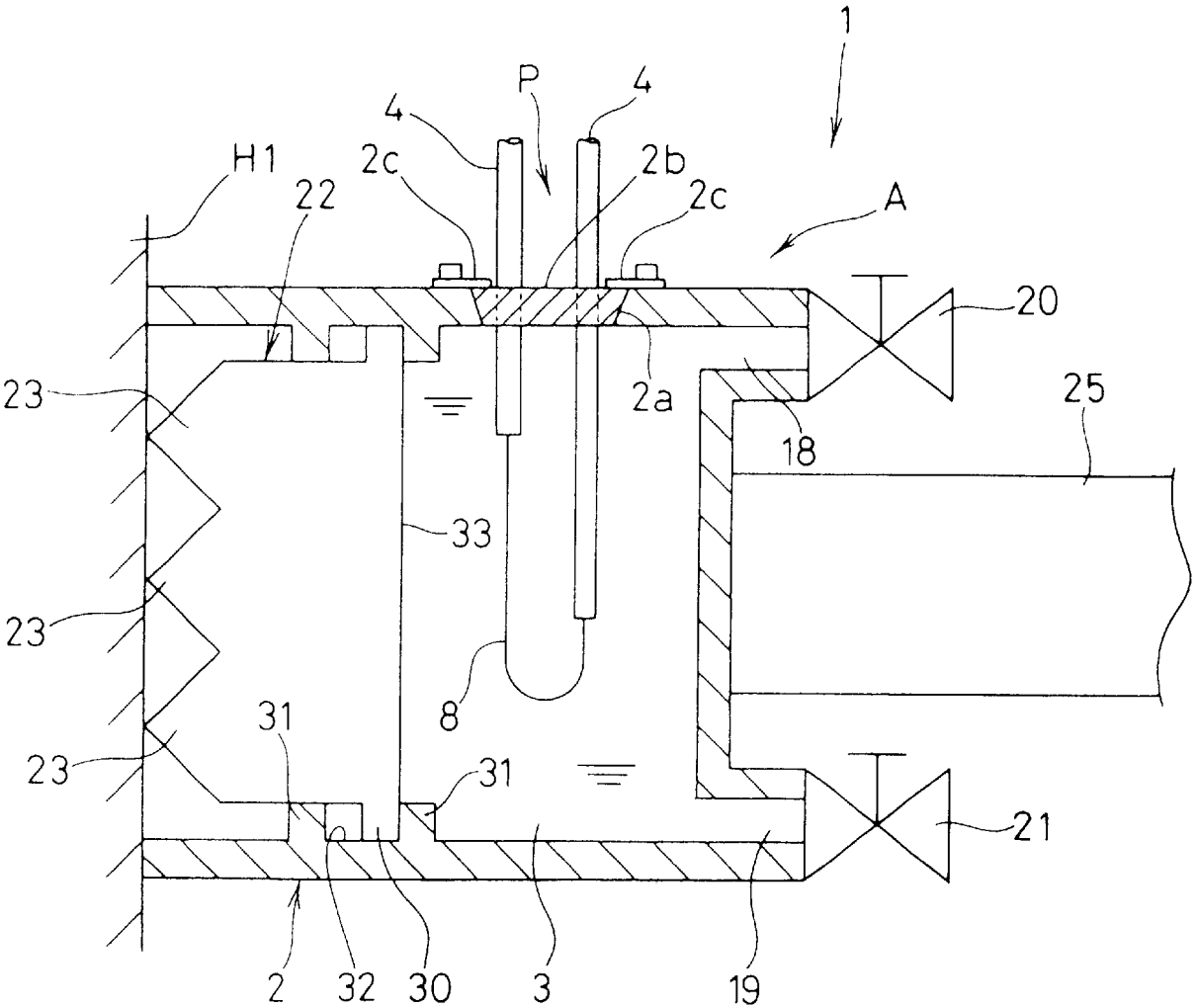
FIG. 1 is a sectional view of a blasting apparatus in accordance with a first embodiment of the present invention.
Figure 5:
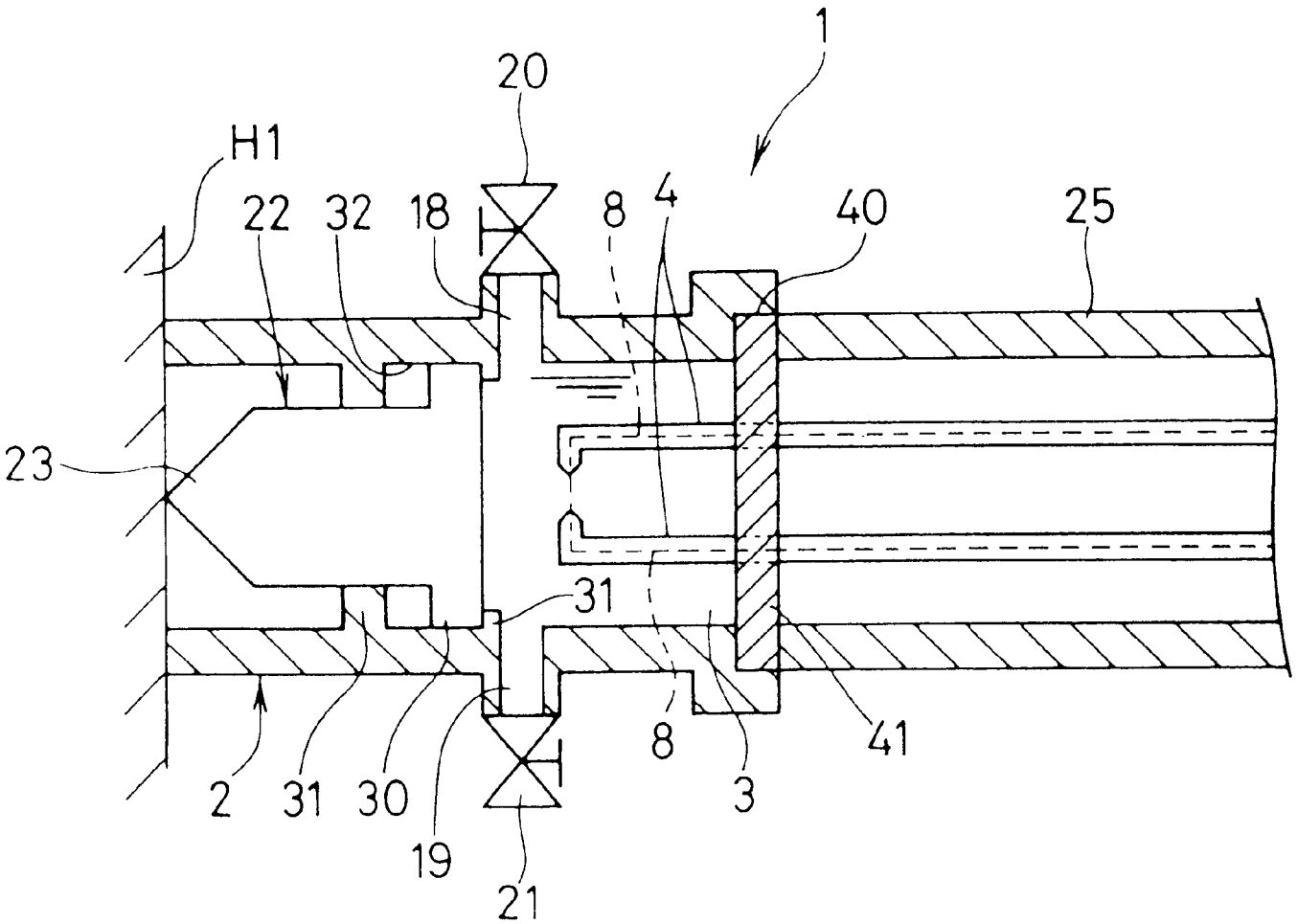
FIG. 5 is a sectional view of a blasting apparatus in accordance with a fourth embodiment of the present invention.

In order to describe the present invention in more detail, a first embodiment of the present invention will first be explained with reference to FIGS. 1 and 5 attached hereto. A blasting apparatus 1 of the first embodiment of the present invention is configured so that an expansion force produced when a thin metal wire (for example, copper is used) 8 is fused and vaporized rapidly by the supply of electrical energy is transmitted by means of a blasting substance (water or oil is used) 3, so that a to-be-blasted object H1 is blasted by using the expansion force. This blasting apparatus 1 is particularly suitable for blasting a plate-shaped to-be-blasted object H1. The blasting apparatus 1 has a blasting vessel 2 which abuts on the surface of to-be-blasted object H1. This blasting vessel 2 is configured so that one end (on the side of the to-be-blasted object H1) is open and the other end is closed, and it is provided with an expansion force generating section A for causing the thin metal wire 8 to generate the expansion force. It is to be noted that the blasting vessel 2 is formed of a metal so as to be able to withstand the expansion force of the thin metal wire 8 and the blasting substance 3.

The expansion force generating section A is provided with a blasting probe P which is installed removably via a retainer 2*c* to an opening 2*a* formed in a drum of the blasting vessel 2. The blasting probe P comprises a pair of electrodes 4, 4 inserted through a cover member 2*b* and the thin metal wire 8 connected between the electrodes 4, 4.

Also, the expansion force generating section A has the blasting substance 3 for transmitting to a later-described shock delivering member 22 the expansion force generated when the thin metal wire 8 is fused and vaporized rapidly by electrical energy supplied thereto for a short period of time, an energy supply circuit 9 for supplying electrical energy to the thin metal wire 8, a filling port 18 for filling the blasting substance 3 into the blasting vessel 2, and a discharge port 19 for discharging the blasting substance 3 having been used from the blasting vessel 2.

Figure 2:
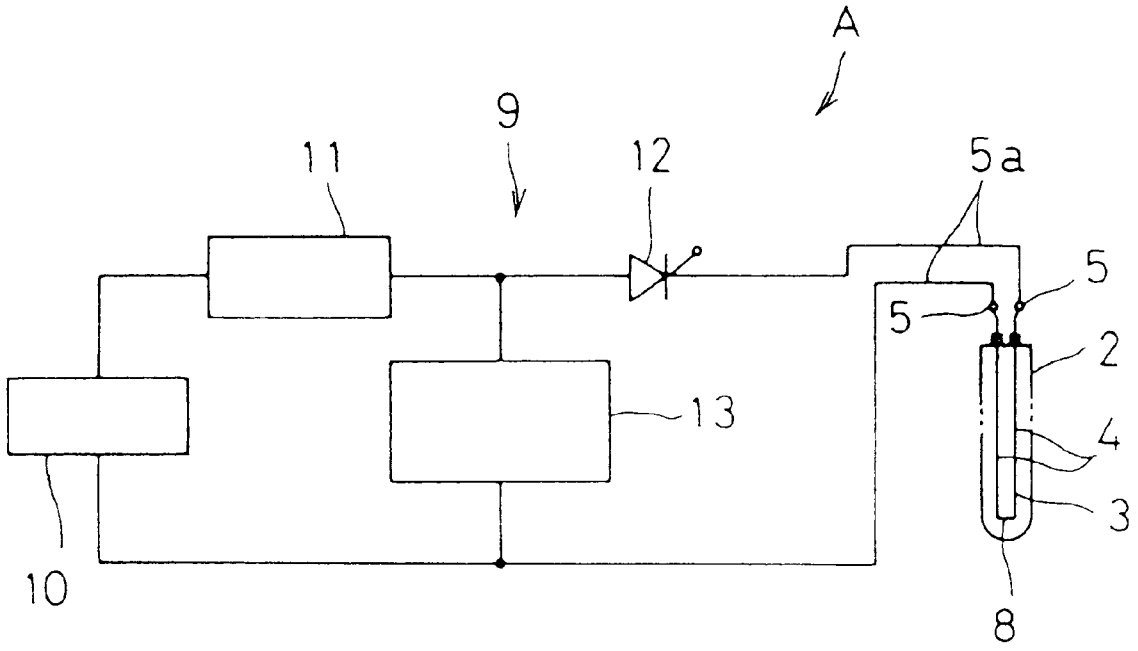
FIG. 2 is a schematic view showing a configuration of an energy supply circuit for the first embodiment of the blasting apparatus.

As shown in FIG. 2, the energy supply circuit 9 comprises a power source 10 connected between terminals 5, 5 of the electrodes 4, 4 via lead wires 5*a*, a capacitor 13 connected in parallel between the power source 10 and the terminals 5, 5, a controller 11 for controlling charging which is connected between the capacitor 13 and the power source 10 and is provided with a charging switch (not shown), and a discharge switch 12 connected between the controller 11 and one of the terminals 5.

Also, the filling port 18 and the discharge port 19 are formed on the other side of the blasting vessel 2, and configured so as to be opened and closed freely. Valve devices (one example of sealing means) 20, 21 that can withstand the expansion force generated when the thin metal wire 8 is fused and vaporized are provided at the filling port 18 and the discharge port 19, respectively.

The shock delivering member 22 delivers a shock to the surface of the to-be-blasted object H1 by colliding therewith. The shock delivering member 22 is incorporated movably in the blasting vessel 2 on one side thereof, and configured so that a plurality of sharp noses 23 are formed on the tip end side thereof that collides with the to-be-blasted object H1, and an enlarged-diameter portion 30 having a pressure receiving surface 33 is formed on the base end thereof. In the blasting vessel 2, there is formed a ring-shaped protrusion 31 for restricting the movement of the enlarged-diameter portion 30. It is to be noted that the shock delivering member 22 is formed of a metal so as to be able to withstand a shock caused by the expansion force.

On the other side of the blasting vessel 2, a rod 25 of an air cylinder device (one example of pressing means, and not shown) is installed so as to press the blasting vessel 2 toward the to-be-blasted object H1.

The following is a description of a method for blasting the to-be-blasted object H1 by using the blasting apparatus 1 configured as described above. First, a predetermined number of blasting probes P are prepared by inserting the pair of electrodes 4, 4 through the cover member 2*b* and by joining the thin metal wire 8 between the tip ends of the electrodes 4, 4 by welding or other means. The cover member 2*b* is fitted to the opening 2*a* formed in the drum of the blasting vessel 2, and fixed with a retainer 2*c*. Next, the blasting substance 3 is filled into the blasting vessel 2 through the filling port 18 with the valve device 20 being open and the valve device 21 being closed, and thereafter the valve device 20 is closed. In this state, the thin metal wire 8 is immersed in the blasting substance 3.

The shock delivering member 22 is pressed to one side of the blasting vessel 2, that is, toward the to-be-blasted object H1 by a pressure caused by the filling of the blasting substance 3. The enlarged-diameter portion 30 is guided by a guide surface 32, and the sharp noses 23 of the shock delivering member 22 protrude from the blasting vessel 2. When the air cylinder device is driven while applying the rod 25 to the blasting vessel 2, the blasting vessel 2 is pressed to the side of the surface of the to-be-blasted object H1 against the pressure of the blasting substance 3. Thus, the end face of one side of the blasting vessel 2 abuts on the surface of the to-be-blasted object H1, and at the same time, the shock delivering member 22 is pushed back to the other side of the blasting vessel 2, so that the sharp noses 23 are pressed on the surface of the to-be-blasted object H1.

In this state, the energy supply circuit 9 is connected between the terminals 5, 5 of the pair of electrodes 4, 4, and the charging switch on the controller 11 is turned on to thereby charge electrical energy in the capacitor 13. Then, the electrical energy is supplied to the thin metal wire 8 via the electrodes 4, 4 for a very short period of time by turning on the discharge switch 12. Alternatively, electrical energy has been charged in the capacitor 13 in advance, and the electrical energy is supplied to the thin metal wire 8 via the electrodes 4, 4 for a very short period of time by turning on the discharge switch 12.

Thus, the thin metal wire 8 is fused and vaporized rapidly, and the blasting substance 3 is vaporized rapidly, so that an expansion force is generated at this time. Since the filling port 18 and the discharge port 19 are closed sealingly by the valve devices 20 and 21, and the blasting vessel 2 is pressed toward the to-be-blasted object H1 by the rod 25 of the air cylinder device, the generated expansion force acts on the pressure receiving surface 33 of the shock delivering member 22, so that the sharp noses 23 of the shock delivering member 22 deliver a shock to the surface of the to-be-blasted object H1, whereby the to-be-blasted object H1 is blasted or embrittled.

Thereafter, the rod 25 is retracted by releasing the pressure of the air cylinder device, and the blasting substance 3 having been used is discharged through the discharge port 19 by opening the valve device 21, by which the blasting vessel 2 is separated from the to-be-blasted object H1.

When the blasting work is performed continuously, the blasting probe P is replaced by removing the retainer 2*c*, the blasting substance 3 is newly filled into the blasting vessel 2 through the filling port 18 with the valve device 20 being open and the valve device 21 being closed as in the aforementioned case, and then the valve device 20 is closed. The sharp noses 23 of the shock delivering member 22 are caused to abut on the surface of the to-be-blasted object H1 and the rod 25 of the air cylinder device is caused to abut on the other side of the blasting vessel 2, the blasting vessel 2 is pressed toward the surface of the to-be-blasted object H1 against the pressure of the blasting substance 3 by driving the air cylinder device, and the energy supply circuit 9 is connected between the terminals 5, 5 of the electrodes 4, 4. Thereafter, the charging switch on the controller 11 is turned on to thereby charge electrical energy in the capacitor 13. Then, the electrical energy is supplied to the thin metal wire 8 for a very short period of time by turning on the discharge switch 12. As a result, the thin metal wire 8 is fused and vaporized rapidly, and the blasting substance 3 is vaporized rapidly, so that an expansion force is generated at this time. By this expansion force, the sharp noses 23 of the shock delivering member 22 deliver a shock to the surface of the to-be-blasted object H1, whereby the to-be-blasted object H1 is blasted or embrittled.

It is to be noted that the blasting vessel 2 and the shock delivering member 22 can be used repeatedly because they are formed of a metal so as to be able to withstand a shock caused by the expansion force of the thin metal wire 8 and the blasting substance 3.

As described above, in the first embodiment of the present invention, the shock delivering member 22 is caused to collide with (pressed strongly on) the surface of the to-be-blasted object H1 by using the expansion force of the thin metal wire 8 and the blasting substance 3. Therefore, even if the to-be-blasted object H1 has a plate shape, it can be blasted by effectively using the expansion force of the thin metal wire 8 and the blasting substance 3.

Also, the blasting vessel 2 and the shock delivering member 22 are formed of a metal so as to be able to withstand a shock caused by the expansion force of the thin metal wire 8 and the blasting substance 3, so that they can be used repeatedly. Also, the blasting probe P is made up of the pair of electrodes 4, 4 inserted through a cover member 2*b* and the thin metal wire 8 connected between the electrodes 4, 4. Therefore, when the blasting work is performed continuously, the blasting apparatus 1 can be formed by merely replacing the blasting probe P, which is convenient and increases the working efficiency.

Figure 3:
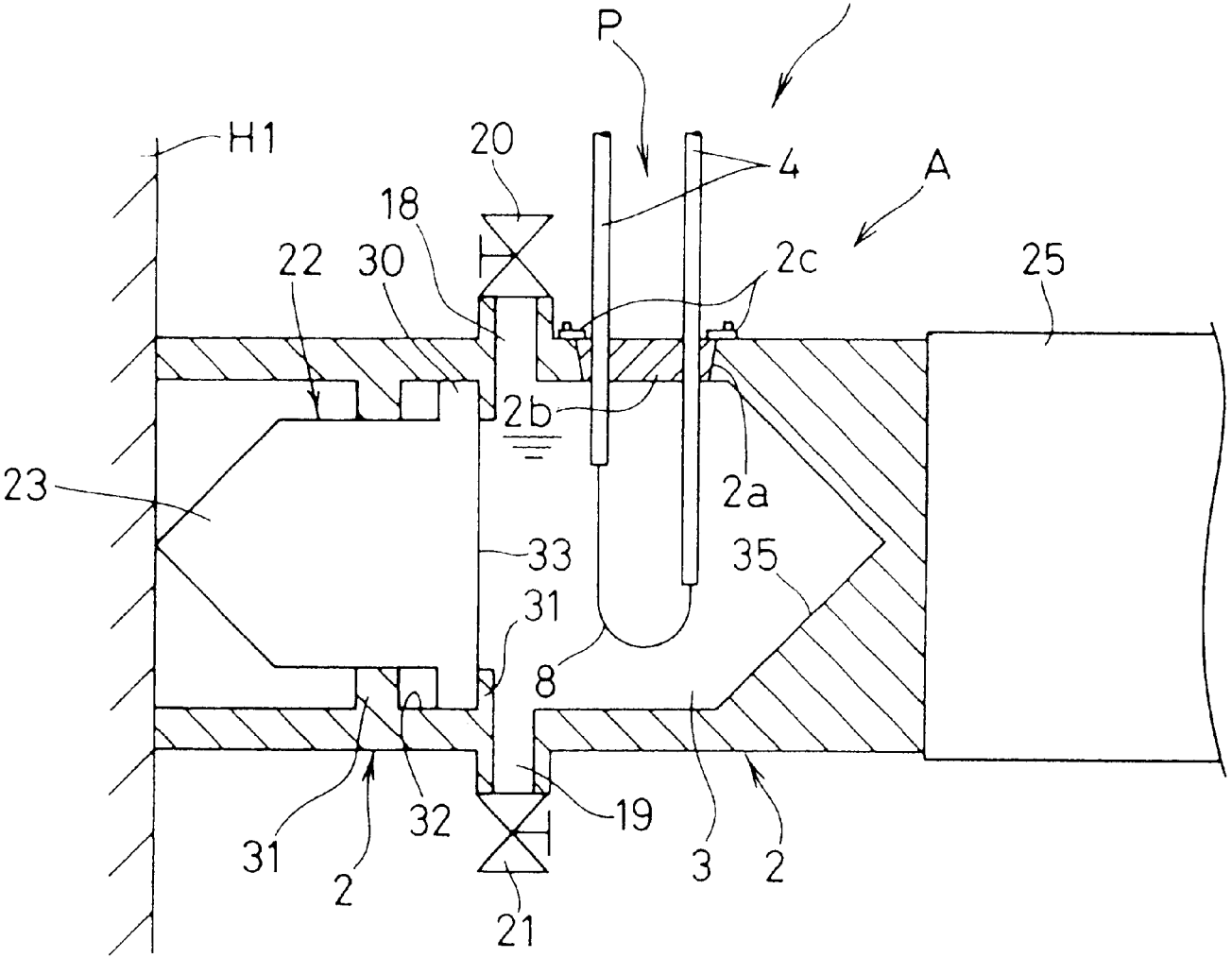
FIG. 3 is a sectional view of a blasting apparatus in accordance with a second embodiment of the present invention.

Next, a second embodiment of the present invention will be described with reference to FIG. 3. In the blasting apparatus 1 in accordance with the second embodiment of the present invention, the filling port 18 and the discharge port 19 are formed in the drum of the blasting vessel 2, and provided with the valve devices 20 and 21, respectively. In order to concentrate an expansion force on the shock delivering member 22, a reflecting face 35 formed into a conical shape is formed on the inside surface on the other side of the blasting vessel 2. Also, only one sharp nose 23 is formed on the tip end side of the shock delivering member 22, which collides with the to-be-blasted object H1. The configuration of the blasting probe P and other configurations are the same as those in the aforementioned first embodiment, and therefore the explanation thereof is omitted.

In this configuration, the filling and discharge of the blasting substance 3 are performed through the filling port 18 and the discharge port 19 formed in the drum of the blasting vessel 2, respectively. When electrical energy is supplied to the thin metal wire 8, the generated expansion force acts concentrating on the central portion of the pressure receiving surface 33 of the shock delivering member 22 by the function of the reflecting face 35 formed into a conical shape. Therefore, the to-be-blasted object H1 can be blasted reliably by the shock delivering member 22.

Each time the blasting work is finished, the blasting probe P is replaced, and the blasting substance 3 in the blasting vessel 2 is replaced. Other operations and effects are the same as those in the first embodiment, and therefore the explanation thereof is omitted.

Although the reflecting face 35 is formed into a conical shape in the aforementioned second embodiment, the shape is not limited to this, but the reflecting face may be formed into a hemispherical or parabolic face or other curved faces. In this case as well, the expansion force generated when electrical energy is supplied to the thin metal wire 8 acts concentratedly on the central portion of the pressure receiving surface 33 of the shock delivering member 22 by the function of the reflecting face 35. Therefore, the to-be-blasted object H1 can be blasted reliably by the shock delivering member 22.

Figure 4:
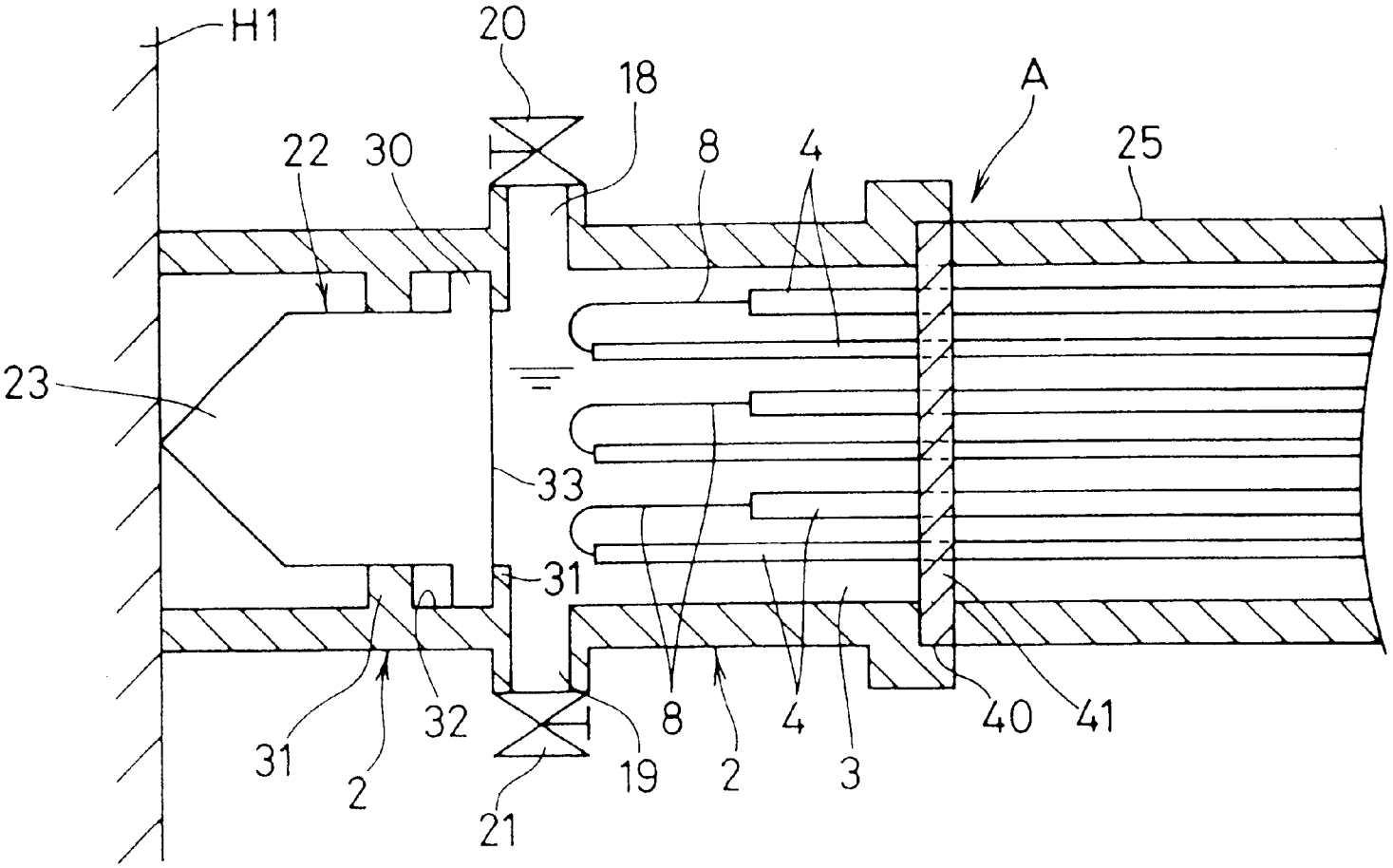
FIG. 4 is a sectional view of a blasting apparatus in accordance with a third embodiment of the present invention.

Next, a third embodiment of the present invention will be described with reference to FIG. 4. In the blasting apparatus 1 in accordance with the third embodiment of the present invention, the rod 25 of the air cylinder device, which presses the other side of the blasting vessel 2, is formed into a hollow shape, and the tip end portion of the rod 25 is also used as a cover member 41 which covers an opening 40 formed on the other side of the blasting vessel 2. A plurality of pairs (three pairs in the figure) of electrodes 4, 4 are inserted through the cover member 41, and the thin metal wire 8 is connected between each pair of electrodes 4, 4, by which the blasting probe P is formed.

The filling port 18 and the discharge port 19 are formed in the drum of the blasting vessel 2, and provided with the valve devices 20 and 21, respectively. Also, only one sharp nose 23 is formed on the tip end side of the shock delivering member 22, which collides with the to-be-blasted object H1. At the base end of the shock delivering member 22, there is formed the enlarged-diameter portion 30 having the pressure receiving surface 33. In the blasting vessel 2, there are formed a ring-shaped guide surface 32 for guiding the movement of the enlarged-diameter portion 30 and a ring-shaped protrusion 31 for restricting the movement thereof.

In the blasting apparatus 1 configured as described above, a plurality of pairs of electrodes 4, 4 are inserted through the cover member 41, and the thin metal wire 8 is connected between each pair of electrodes 4, 4, by which the blasting probe P is formed. Therefore, the expansion force generated when electrical energy is supplied to each thin metal wire 8 is higher than the case where one thin metal wire 8 is provided, and the expansion force acting on the pressure receiving surface 33 of the shock delivering member 22 increases. Thereupon, since the force by which the sharp nose 23 of the shock delivering member 22 presses the surface of the to-be-blasted object H1 increases, the blasting force can be increased, and the to-be-blasted object H1 can be blasted reliably. Each time the blasting work is finished, the blasting probe P is replaced, and the blasting substance 3 in the blasting vessel 2 is replaced.

Next, a fourth embodiment of the present invention will be described with reference to FIG. 5. In the blasting apparatus 1 in accordance with the fourth embodiment of the present invention, the rod 25 of the air cylinder device, which presses the other side of the blasting vessel 2, is formed into a hollow shape, and the tip end portion of the rod 25 is also used as the cover member 41 which covers the opening 40 formed on the other side of the blasting vessel 2. A pair of pipe-like electrodes 4, 4 are inserted into the blasting vessel 2 through the cover member 41, and thin metal wires 8, 8 are inserted in the respective electrodes 4, 4 so as to be capable of extruding to a gap between the tip ends of the electrodes 4, 4. Other configurations are the same as those in the third embodiment, and therefore the explanation thereof is omitted.

In the blasting apparatus 1 configured as described above, the electrodes 4, 4 are first inserted through the cover member 41, and the thin metal wires 8, 8 are inserted in the respective electrodes 4, 4, whereby the blasting probe P is prepared. At this time, the tip end of the thin metal wire 8, 8 protrudes slightly to the gap between the electrodes 4, 4, and the thin metal wires 8, 8 are not in contact with each other.

Next, the blasting substance 3 is filled into the blasting vessel 2 through the filling port 18 with the valve device 20 being open and the valve device 21 being closed, and then the valve device 20 is closed. At this time, the thin metal wires 8, 8 are immersed in the blasting substance 3.

The shock delivering member 22 is pressed to one side of the blasting vessel 2 by the pressure of the blasting substance 3, and the enlarged-diameter portion 30 is guided by the guide surface 32 so that the sharp nose 23 of the shock delivering member 22 protrudes from the blasting vessel 2.

In this state, the sharp nose 23 is caused to abut on the surface of the to-be-blasted object H1, and the blasting vessel 2 is pressed toward the surface of the to-be-blasted object H1 against the pressure of the blasting substance 3 by driving the air cylinder device. Then, the shock delivering member 22 is pushed back to the other side of the blasting vessel 2, and the end face on one side of the blasting vessel 2 is caused to abut on the surface of the to-be-blasted object H1. Thereafter, the energy supply circuit 9 is connected between the terminals 5, 5 of the electrodes 4, 4. By turning on the charging switch of the controller 11, electrical energy is charged in the capacitor 13. Alternatively, electrical energy has been charged in the capacitor 13 in advance, and the electrical energy is supplied to the thin metal wire 8 via the electrodes 4, 4 for a very short period of time by turning on the discharge switch 12. Then, gap discharge takes place between the tip ends of the thin metal wires 8, 8. As a result, the tip end portion (exposed portion from the electrode 4, 4) of the thin metal wire 8, 8 is fused and vaporized rapidly, and the blasting substance 3 is vaporized rapidly, so that an expansion force is generated at this time. The generated expansion force acts on the pressure receiving surface 33 of the shock delivering member 22, and the to-be-blasted object H1 is blasted or embrittled by the sharp nose 23 of the shock delivering member 22.

Thereafter, the blasting substance 3 having been used is discharged through the discharge port 19 by opening the valve device 21, and the blasting vessel 2 is separated from the to-be-blasted object H1 by releasing the pressure of the air cylinder device.

When the blasting work is performed continuously, the thin metal wires 8, 8 are extruded to the gap, and the blasting substance 3 is filled into the blasting vessel 2 through the filling port 18 with the valve device 20 being open and the valve device 21 being closed, and then the valve device 20 is closed. The sharp nose 23 of the shock delivering member 22 is caused to abut on the surface of the to-be-blasted object H1, and the blasting vessel 2 is pressed toward the surface of the to-be-blasted object H1 against the pressure of the blasting substance 3 by driving the air cylinder device.

Since the electrical energy is supplied to the thin metal wires 8, 8 for a very short period of time, the tip ends of the thin metal wires 8, 8 are fused and vaporized rapidly, and blasting substance 3 is vaporized rapidly. Owing to the expansion force generated at this time, the sharp nose 23 of the shock delivering member 22 delivers a shock to the surface of the to-be-blasted object H1, so that the to-be-blasted object H1 is blasted or embrittled.

In the aforementioned fourth embodiment, the blasting work can be performed continuously by extruding the thin metal wire 8 to the gap and by filling the blasting substance 3 into the blasting vessel 2. Therefore, the efficiency of the blasting work can be improved.

Although one pair of electrodes 4, 4 is provided in the aforementioned fourth embodiment, the configuration is not limited to this. As in the aforementioned third embodiment, a plurality of pairs of electrodes 4, 4 may be inserted through the cover member 41. In this configuration, the thin metal wire 8, 8 is inserted in each electrode 4, 4, and electrical energy is supplied to each thin metal wire 8, 8 at the same time, by which the thin metal wires 8, 8 and the blasting substance 3 are expanded so that the to-be-blasted object H1 is blasted by the expansion force. In this case, the expansion force increases, so that the to-be-blasted object H1 can be blasted reliably.

INDUSTRIAL APPLICABILITY

As described above, the present invention is suitable for the case where it is difficult to form a mounting hole in the to-be-blasted object or the case where blasting work is performed over a wide range.

What is claimed is:

1. A blasting apparatus comprising:

a shock delivering member incorporated movably in a vessel and delivering a shock to a to-be-blasted object by colliding with the surface of the to-be-blasted object;

an expansion force generating section provided in the vessel and being capable of producing an expansion force for causing the shock delivering member to collide with the surface of the to-be-blasted object;

said expansion force generating section including a pair of electrodes inserted through a cover member installed removably to an opening formed in the vessel, a thin metal wire connected between the electrodes, a fluid blasting substance for transmitting to the shock delivering member an expansion force generated when the thin metal wire is fused and vaporized rapidly by electrical energy supplied to the thin metal wire via the electrodes for a short period of time, a filling port for filling the blasting substance into the vessel, and a discharge port for discharging the blasting substance having been used from the vessel;

sealing means for sealing the filling port and the discharge port, respectively; and a pressing means for pressing the vessel toward the to-be-blasted object.

2. A blasting apparatus according to claim 1, wherein a plurality of pairs of electrodes are inserted through the cover member, and the thin metal wire is connected between the respective pair of electrodes.

3. A blasting apparatus comprising:

a shock delivering member incorporated movably in a vessel and delivering a shock to a to-be-blasted object by colliding with the surface of the to-be-blasted object;

an expansion force generating section provided in the vessel and being capable of producing an expansion force for causing the shock delivering member to collide with the surface of the to-be-blasted object;

said expansion force generating section including electrodes inserted into the vessel, thin metal wires inserted in each of the electrodes so as to be capable of extruding to a gap between the electrodes, a fluid blasting substance for transmitting to the shock delivering member an expansion force generated when the thin metal wire is fused and vaporized rapidly by electrical energy supplied to the thin metal wire via the electrodes for a short period of time, a filling port for filling the blasting substance into the vessel, and a discharge port for discharging the blasting substance having been used from the vessel;

a sealing means for sealing the filling port and the discharge port, respectively; and a pressing means for pressing the vessel toward the to-be-blasted object.

4. A blasting apparatus according to claim 3, wherein a plurality of pairs of electrodes are inserted into the vessel, and the thin metal wire is inserted in each of the electrodes so as to be capable of extruding to the gap between the pair of electrodes.

5. A blasting apparatus according to any one of claims 1 to 4, wherein an inclined or curved reflecting face is formed in the vessel to concentrate the expansion force on the shock delivering member.

* * * * *